United States Patent [19]

Ayers

[11] 4,051,571

[45] Oct. 4, 1977

[54] TOOTHBRUSH

[76] Inventor: Herbert D. Ayers, 38 Mineola Ave., Roslyn, N.Y. 11576

[21] Appl. No.: 691,471

[22] Filed: June 1, 1976

[51] Int. Cl.[2] ..... A46B 9/04

[52] U.S. Cl. ..... 15/167 R; 15/143 R

[58] Field of Search ..... 15/167 R, 167 A, 110, 15/143–145

[56] References Cited

U.S. PATENT DOCUMENTS

| | | | |
|---|---|---|---|
| 1,346,536 | 7/1920 | Fitz-Gibbon | 15/167 R |
| 1,468,888 | 9/1923 | Stuart | 15/167 R |
| 1,731,751 | 10/1929 | Neissl | 15/176 |
| 3,229,318 | 1/1966 | Clemens | 15/167 R |
| D. 109,472 | 5/1938 | Clarren | 15/167 R |

*Primary Examiner*—Peter Feldman

[57] ABSTRACT

A toothbrush comprising a brush head and a handle, the brush head carrying three rows of bristle tufts which form a generally T-shaped pattern when viewed from above. A first and second row of tufts extend angularly toward each other and intersect in a plane which runs generally parallel to the longitudinal axis of the brush. A cross row of tufts at the end of the brush head inclines toward the other tufts to from the T-pattern. The handle is specially contoured near the brush head to facilitate movement of the brush over the teeth.

5 Claims, 10 Drawing Figures

FIG. 1.
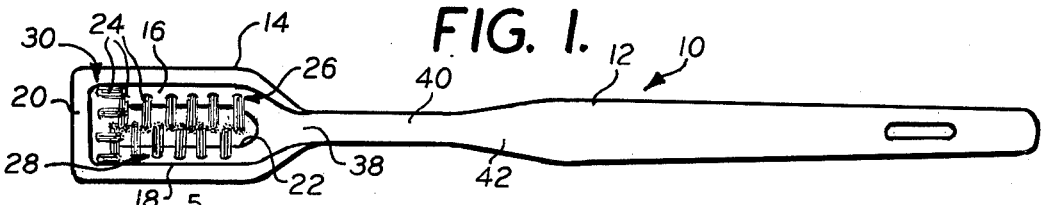
FIG. 2.
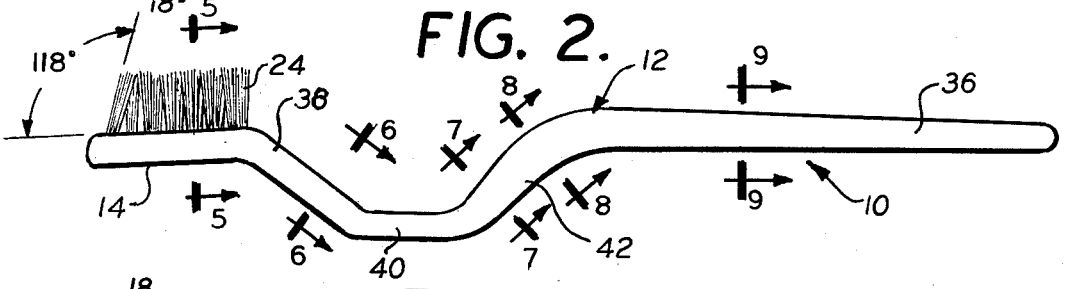
FIG. 3.
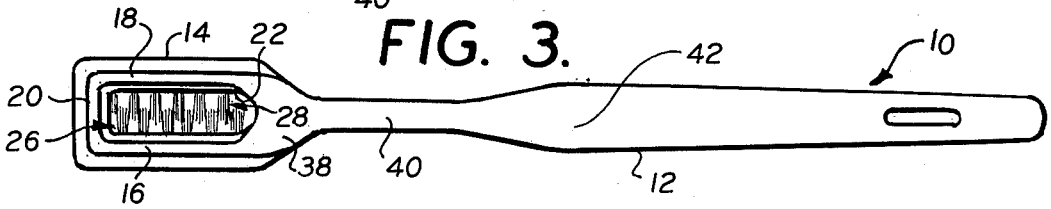
FIG. 4.
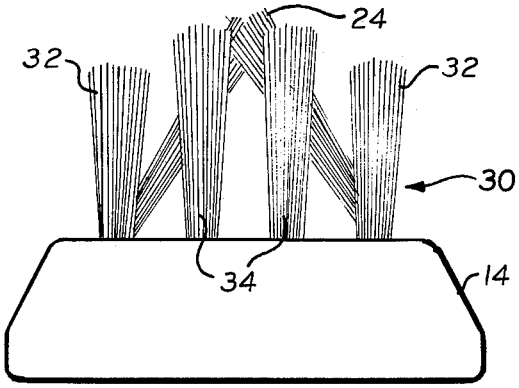
FIG. 5.
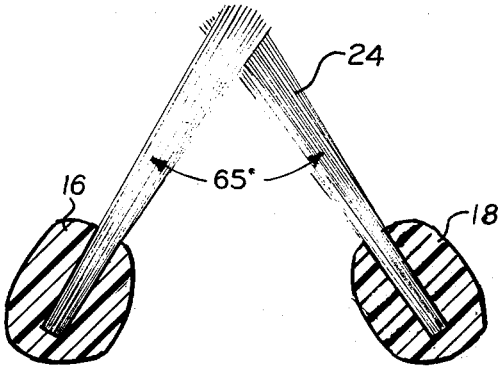
FIG. 6.
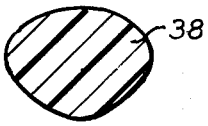
FIG. 7.
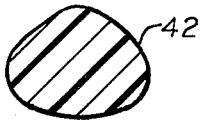
FIG. 8.
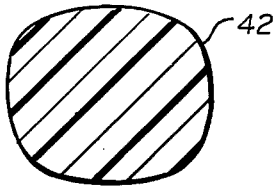
FIG. 9.
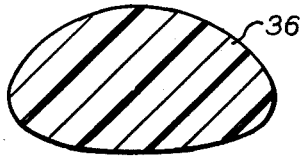
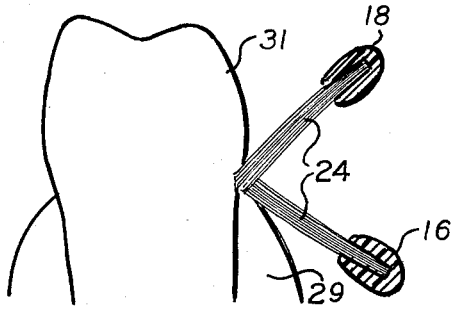
FIG. 10.

TOOTHBRUSH

FIELD OF INVENTION

This invention relates to a toothbrush, and more specifically to a particular toothbrush having a specific arrangement of bristle tufts as well as other advantageous constructional features.

BACKGROUND OF THE INVENTION

The diseases of gingivitis and periodontis afflict large segments of our population. Such diseases are aggravated by the failure of the individual to remove food, bacteria and plaque lodged in the sulcus area between the teeth and the gingivae using presently available toothbrushes. The severity and pervasiveness of these diseases must be appreciated.

Uncomplicated chronic marginal gingivitis is the most common disease of the gingivae. It is the initial stage of the pocket formation and is always caused by local irritation, generally in the sulcus area. Gingivitis afflicts 65 percent the nation's school children. Periodontal disease is generally considered to be a disease of adults and its prevalence and severity increase with age. The incidence in the 19 to 25 year group is from 10 to 29 percent. While by age 45, 95, to 100 percent have periodonatal disease. The early stage of periodontal disease is gingivitis. At this stage, the gums become tender, swell, bleed and begin to recede. Later, the gingivae recede permanently. The teeth then become loose due to loss of supporting bone. Eventually the supporting structure for the teeth become so destroyed that extraction and replacement of teeth are required.

The recommended procedure for prevention and treatment of gingivitis and periodontitis is oral physiotherapy, the most important aspect of which is the use of a toothbrush for cleansing tooth surfaces, especially those in contact with the gingivae. Toothbrushing performed shortly after each meal keeps bacterial activity and irritation from plaque and food debris to a minimum.

The toothbrushing technique appropriate for use with the conventional toothbrush requires a great deal of operator manipulation which most people fail to do. The error most people make is that the toothbrush bristle ends are placed substantially squarely against the tooth face. By such method, the sulcus area between the tooth face and the gingivae is not cleaned when the brush is moved vertically or crosswise. In the proper method, the brush is inclined towards the gingivae by a rotation of approximately 45° from the incorrect substantially square position. With such method, the bristles flex and some find their way into the sulcus area. Then, an arcuate motion of the brush head while keeping the bristle ends in place provides a cleansing action. This motion may also be supplemented by a motion of the brush in a direction perpendicular to the plane of view. This angulation and mechanical manipulation is often not possible by the operator particularly in the molar areas of the mouth and on the inner sides of the teeth. Furthermore, improper use of this method may do more harm than good. Excessive pressure and/or improper angle of the brush may cause the bristle ends to pierce the gingivae and thereby traumatize them.

In view of the difficulties encountered with the use of a conventional toothbrush, a wide variety of variations and modifications have been attempted. However, such modifications usually are so complicated that either the manufacturer cannot mass produce the brush economically or the user cannot be expected to obtain proper results without akward motion or tedious effort. Modifications such as angled bristles, long and short tufts and various complicated bristle or tuft placement have all failed to produce a commercially successful brush which pleases the manufacturer and user alike.

It is the primary object of this invention, therefor, to provide a toothbrush which is both economical to manufacture and effectively employed by the user to easily clean all of the teeth.

It is another object of this invention to provide a toothbrush which aids in the effective brushing of the most difficult tooth areas such as the lingual of the lower teeth and the distal of the last lower molars.

It is still another object of this invention to provide a toothbrush which is structured to allow ease of placement in any area of the mouth without interference or injury to the user.

SUMMARY OF THE INVENTION

Broadly the objects of the invention are satisfied by a toothbrush which comprises a brush head, a handle connected to the brush head and three rows of tufts of bristles extending outwardly from the brush head. The bristle tufts in the first and second row are aligned substantially parallel to the longitudinal axis of the brush. The tufts of the first row angularly extend outwardly from the base of the brush head all in the same general direction while the tufts of the second row extend angularly toward those of the first row. The bristle ends in these rows of tufts intersect in a plane at about the center of the brush head. The third group of tufts is aligned across the brush head so as to form a row which is generally perpendicular to the first and second row. The plane of the third row forms a T-shaped pattern with the plane of intersection of the first and second rows. The tufts of the third row are preferably angled toward the first and second rows as they extend out from the base. Furthermore, the tufts in the central portion of the third row are generally longer than the tufts at the periphery of this row.

This particular toothbrush construction, in addition to being economical to produce on a mass production basis, provides several important advantages over conventional and other prior art devices. The bristles at the intersection of the first and second rows form a single row of bristles which may be readily directed to and contact the important area at the junction of the gingiva and the crown of a tooth. When so located, vibration of the brush and the resultant pressure causes the working bristles to bend slightly thereby allowing the sides of the bristles to brush against the tooth and gingiva simultaneously while also cleaning the pocket between them. Furthermore, this construction easily permits the third row of bristles to be placed on the lingual of the lower anteriors with the shorter outer tufts following the curvature of the arch. This third row of tufts also readily reaches the distal of the last molars without injuring the tissue. With the bristle ends pointing at the lower molar gingival thirds, it is simple to use a vibratory motion and swing continuously forward, thereby cleaning areas which are typically unreached with a conventional brush. Turning the handle upward allows brushing against the lingual of the lower anteriors completing the lingual to the midline. By a series of uncomplex motions, the user not only brushes the teeth, but cleans all vital areas each time the brushing procedure is effected.

Thus by arranging bristle tufts in a particular manner, the problems of prior art brushes are obviated.

Other features of the toothbrush of the invention also aid in the overall performance. For example, the handle may be structured to include a first portion which is adapted to be grasped by the user and is substantially coplanar with the brush head. A second portion of the handle is connected between the brush head and the first portion. This second portion extends away from the brush head, in a direction generally opposite to the direction of the extension of the tufts and then back up to connect with the first portion. The second portion, in effect, forms a U-shaped like bend in the handle of the brush. Ths construction enables the brush head to pass over teeth without interferece of other teeth, lips or other possible obstacles and aids the user substantially in avoiding injury. It also enables the user to view the area being brushed much more readily. Moreover, this second portion of the handle is provided with a cross sectional area which is smaller than that of the first portion of the handle to further facilitate movement of the brush while the second portion of the handle is in the mouth. Still another important feature of the toothbrush is the fact that the brush head defines a large central opening which is in registration with the bristle tufts of the several rows. This enables immediate and complete cleaning of the brush to occur by passing water of other cleasing fluid through the opening and onto the bristles.

BRIEF DESCRIPTION OF THE DRAWINGS

The above objects and other advantages are satisfied by the present invention as will become apparent from the following description taken in conjunction with the accompanying drawing, in which, FIG. 1 is a top plan view of the toothbrush of the invention;

FIG. 2 is a side elevational view of the toothbrush shown in FIG. 1;

FIG. 3 is a bottom view of the toothbrush shown in FIGS. 1 and 2;

FIG. 4 is an end view of the toothbrush as viewed from the brush head end;

FIG. 5 is a cross sectional view taken on line 5—5 in FIG. 2;

FIGS. 6, 7, 8 and 9 are cross sectional views taken on lines 6—6, 7—7, 8—8, and 9—9 in FIG. 2; and FIG. 10 is an elevational view of a tooth and gingiva and several tufts of the toothbrush in brushing position.

DETAILED DESCRIPTION OF THE DRAWINGS

Referring now to the drawing, and first to FIG. 1, a toothbrush 10 comprises a handle 12 and a brush head or brush carrying member 14 integrally connected to the handle. The brush head 14 includes two side sections 16 and 18 and an end section 20 (also shown in FIG. 3). These sections define a large central opening 22 which is useful to permit water or other cleansing fluid to pass through the brush head and quickly clean the bristles. As illustrated best in FIG. 1, a plurality of bristle tufts 24 extend outwardly from the sections 16, 18 and 20. These tufts are grouped into three rows, the first row of generally aligned tufts is positioned along section 16 and is generally parallel to the longitudinal axis of the toothbrush 10. This row is generally designated by the numeral 26. The second row 28 of tufts 24 is similarly positioned along section 18 and is substantially parallel to the first row 26. The third row 30 extends along end section 20 and is basically perpendicular to the first two rows. As illustrated in the drawing, and particularly in FIGS. 1, 4 and 5, the tufts in rows 26 and 28 extend at an angle outwardly from sections 16 and 18 to a position above about the midline of the brush. The tufts of row 26 are staggered relative to the tufts of row 28 so that the tufts support each other at their terminal ends. The extension of the long axis of the tufts in these two rows is such that they all terminate in a plane, thereby effectively forming a single row of bristles to be applied to the teeth. As shown in FIG. 1, the bristles along the plane of intersection form the stem of the T-shaped pattern which is established by the tufts 24. As best seen in FIG. 5, the tufts of rows 26 and 28 extend from sections 16 and 18 so as to form an angle of about 65° between tuft centerlines at the plane of intersection.

The single row of bristles at the centerline of the brush is easily directed to and contacts the important area at the junction of gingiva 29 and crown 31 as shown in FIG. 10. When so located, vibratory motion by the user causes the bristles to bend slightly thus enabling the sides of the bristles to brush against the gingvia and crown simultaneously while also cleaning the pocket between them and the iterproximal spaces. This alignment of tufts enables the user to locate the bristles in this single row directly on difficult to clean areas as shown in FIG. 10 without complex twisting and turning of the toothbrush and without an excessive number of surrounding bristles causing injury to other areas adjacent the area being cleaned.

Referring now to FIGS. 1, 2 and 4, it may be observed that the tufts in row 30 extend upwardly from end section 20 at an angle of about 118 degrees toward the tufts in rows 26 and 28. As shown in FIG. 4, the outer or peripheral tufts 32 in this row are shorter than the central tufts 34. This row completes the T-shaped pattern of the brushing bristles as viewed in FIG. 1. This third row of bristles may be readily placed on the lingual of the lower anteriors with the shorter tufts 32 following the curvature of the arch. The tufts in row 30 are very important in the overall structure of toothbrush 10. With this row 30, difficult to reach areas are thoroughly cleaned with the brush in essentially the same user's position as when it is being used to clean more accessible areas. The bristles in this row may be specifically and exclusively directed to and clean a selected area of the mouth without reliance on the other bristles of the brush. This is an important advantage over prior art brushes in which such selectivity is unavailable. Moreover, this row gives supplemental cleansing action to that of the bristles in the center row when the latter bristles are selected for primary use.

Referring now to FIG. 2, another important structural feature of the toothbrush 10 is illustrated. As there shown, handle 12 is generally U-shaped from the area of intersection with brush head 14 to the piece 36 normally grasped by the user. The handle is directed downwardly away from the direction of extension of the tufts 24 at a first section 38, then becomes substantially parallel to brush head 14 at section 40 and then travels back upwardly to piece 36 with section 42. This particular structural arrangement enables the handle to pass over the opposite lower cuspid when the bristles are pointed directly at the gingival third of the tooth in the lower posterior region. This structure also allows for general freedom of movement of the brush when in operation since the U-shaped portion of the handle is always within or at the edge of the mouth and thus the handle will not bump other teeth as so often happens with a conventional toothbrush. Furthermore, this construction allows the user to easily view the teeth so as to properly locate the brush. In order to further facilitate movement of the brush without interference, the cross sectional area of the handle 12 at sections 38, 40 and 42 is less than the cross sectional area of the remainder of the handle such as at piece 36. This is best shown in FIGS. 6, 7, 8 and 9. The reduced cross section in that portion of the handle which will be within the mouth is of great advantage to the user.

From the foregoing, it will be appreciated that the toothbrush of the invention includes advantageous features which obviate many of the objections to prior conventional devices. The single rows of operable bristles in transverse directions are a significant factor in proper brushing since selective cleaning of all areas may be accomplished without special instruction as to proper brushing technique. Brushing the teeth becomes simple, fast and totally effective, Moreover, the brush may be economically manufactured on a mass production basis and thus achieves the objective of pleasing the manufacturer and user alike.

What is claimed is:

1. A toothbrush comprising an elongated handle, a base member connected to said handle, and a plurality of tufts of bristles connected to and extending outwardly from said base member, said tufts being formed in three distinct rows of adjacent tufts, a first row of tufts spaced along said base member substantially parallel to the longitudinal axis of said toothbrush, the tufts in said first row extending angularly from said base member, a second row of tufts spaced along said base member substantially parallel to said first row of tufts and extending angularly from said base member and toward said first row, the tufts of said first row intersecting opposite tufts in said second row in a single plane along the central portion of said toothbrush thereby to form a single, substantially linear continuous row of bristles, the bristles of said first row being at least partially intermeshed with the bristles of said second row at substantially the outermost portion thereof, and a third row of spaced tufts positioned near the end of said base member farthest from said handle, said tufts being aligned substantially perpendicularly to said first and second rows and extending angularly toward the tufts of said first and second row, said third row having central tufts at least partially contacting the tufts of said first and second row and peripheral tufts extending parallel to said central tufts but not contacting said tufts of said first and second row, the tips of the bristles in said third row and the plane of intersection of said first and second rows forming a T-shaped pattern when viewed from above said toothbrush, said first, second and third rows of tufts being the only rows of tufts on said toothbrush effective to cleanse when contacting teeth.

2. The toothbrush of claim 1, in which the tufts in the central portion of said third row extend from said base member a greater distance than the tufts at the peripheral portion of said third row.

3. The toothbrush of claim 2, in which the tufts of said first row are staggered relative to the tufts of said second row.

4. The toothbrush of claim 3, in which said handle comprises a first portion spaced from said base member and substantially coplanar therewith, and a second portion between said base member and said first portion extending downwardly in a direction opposite to the direction of extension of said tufts and than back upwardly to connect with said first portion.

5. The toothbrush of claim 4, in which the cross sectional area of said second portion of said handle is smaller than the cross sectional area of said first portion of said handle.

* * * * *